US005679081A

United States Patent [19]

Santilli

[11] Patent Number: 5,679,081

[45] Date of Patent: Oct. 21, 1997

[54] GOLF TEE ADJUSTABLE FOR DIFFERENT HEIGHTS

[76] Inventor: Robert Santilli, 956 Oak Creek Dr., South Lyon, Mich. 48178

[21] Appl. No.: 614,134

[22] Filed: Mar. 12, 1996

[51] Int. Cl.[6] ..... A63B 57/00

[52] U.S. Cl. ..... 473/391

[58] Field of Search ..... 473/387, 388, 473/389–402, 391

[56] References Cited

U.S. PATENT DOCUMENTS

| | | | |
|---|---|---|---|
| 1,553,561 | 9/1925 | Scott | 473/400 |
| 1,738,596 | 12/1929 | McLeod | 473/391 |
| 1,846,407 | 2/1932 | Thompson | 473/391 |
| 1,850,560 | 3/1932 | Middendorf | 473/387 |
| 2,011,203 | 8/1935 | Seiki | 473/401 |
| 2,589,763 | 3/1952 | Barrett | 473/391 |
| 2,805,071 | 9/1957 | Kaplan | 273/202 |
| 3,141,671 | 7/1964 | Eyer | 273/33 |
| 3,554,543 | 1/1971 | Laura | 473/387 |
| 3,954,263 | 5/1976 | Whalan | 473/399 |
| 4,162,071 | 7/1979 | Fish et al. | 273/33 |
| 5,052,689 | 10/1991 | Lettrich | 473/398 |
| 5,193,803 | 3/1993 | Flick, III | 273/33 |
| 5,242,161 | 9/1993 | Wilkirson | 473/398 |
| 5,431,392 | 7/1995 | Carson | 473/399 |

*Primary Examiner*—Theatrice Brown
*Attorney, Agent, or Firm*—Barbara M. Burns

[57] ABSTRACT

A golf tee and a method of adjusting the golf tee to different heights. The golf tee has different sized body sections that are separable and may be reattachable. The top different sized section has a golf ball supporting concavity. The tee can be used both outdoors on natural grass and indoors on artificial turf. Outdoors, for high wind conditions, the top different sized section would be separated from the rest of the tee body and only the top section would be used to tee the ball, thus effectively lowering the ball. A lower trajectory is imparted to the ball causing less interaction with the wind. For low or no wind conditions, the full tee or several different sized parts of the tee are used to tee the ball at a greater height for a higher flight trajectory. For indoor use, different sized sections are removable to mimic outdoor shots in various wind conditions. Rubber feet and spikes can be added to the tee to position the tee.

8 Claims, 2 Drawing Sheets

METHOD OF
ADJUSTING A GOLF TEE

DISCONNECTING A
SEPARABLE SECTION
OF A GOLF TEE

FIG. 6

FURTHER METHOD OF
ADJUSTING A GOLF TEE

RECONNECTING A
SEPARABLE SECTION
OF A GOLF TEE

FIG. 7

GOLF TEE ADJUSTABLE FOR DIFFERENT HEIGHTS

BACKGROUND OF THE INVENTION

The field of the invention pertains to devices used for the sport of golfing. In particular, the invention pertains to an adjustable golf tee for supporting a golf ball at selected different heights. In the past, during heavy wind conditions, a golfer needed to push a golf tee deeper into the ground to lower the ball prior to teeing off However, when the ground was hard, this pushing of the golf tee into the ground was difficult. Thus, no known golf me exists that can easily be altered for height and no known method exists to easily modify a golf tee for height.

SUMMARY OF THE INVENTION

The invention is directed to a configurable device and a method for configuring the golf tee by altering the height of the golf tee, but is not limited thereto. Essentially, the invention comprises a tee that is adjustably positioned for different heights. The invention comprises multiple different sized sections that form a pyramidal shape. The sections are separable and may be reattachable. By positioning the sections in various manners, different heights can be achieved. Thus, the tee can be altered for outdoor use in differing wind conditions. The tee can also be used indoors at its full height or at a desired lesser height.

It is envisioned that the device is configurable by tearing or disconnecting one or more of the different sized sections from the body of the tee. For full height, the tee is used without removing any sections. But the tee can be lowered by removing sections, with the overall height of the tee being lessened. Alternately, the tee can be returned to the full height by reconnecting the sections as will be described.

The tee is ideally suited for use both indoors on artificial turf and outdoors on natural grass. Rubber feet keep the tee in place for indoor use, while spikes maintain the tee in position for outdoor use. For use indoors, the height of the tee can be altered for practicing shots simulating various wind conditions.

The method of using the tee outdoors requires an assessment of the severity of the wind at the tee location. For high wind conditions, a low tee is desirable. The tee is then configured to the desired height. For high wind, most of the tee body sections are separated and only the top having the least height is utilized.

The invention is advantageously employable as a single use tee. Moreover, the invention is also useful for multiple instances of use because the height can be reconfigured as desired.

For a more complete understanding of the present invention, reference is made to the following detailed description when read with in conjunction with the accompanying drawings wherein like reference characters refer to like elements throughout the several views, in which:

BRIEF DESCRIPTION OF THE DRAWINGS

FIG. 6 illustrates the method for adjusting the height of the device by disconnecting separable sections; and FIG. 7 illustrates the method for adjusting the height of the device by reconnecting separable sections.

DESCRIPTION OF THE PREFERRED EMBODIMENT

Figure 1:
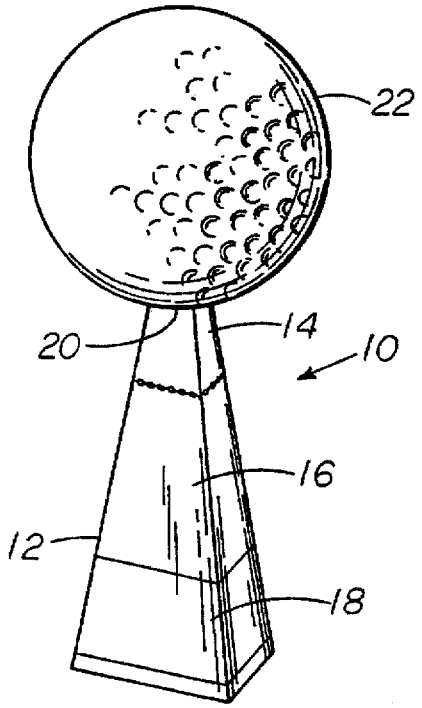
FIG. 1 illustrates an environmental view of the device according to the invention showing a golf ball supported by the device.

In FIG. 1, a device generally denoted as 10 is thereshown. The device 10 comprises a body 12 having a top section 14, a middle section 16 and a lower section 18. It is to be noted that the sections 14, 16 and 18 although having a pyramidal shape are of different sizes. The top section 14 has a concavity 20 at the top for supporting a golf ball 22. The body 12 hereinshown takes the shape of a pyramid, but other shapes can be effectively employed. The body 12 can be formed from a plastic or a biodegradable material, but other materials can be used.

The selection of a biodegradable material for the body is advantageous to the golf course as well as to the golfer. Oftentimes, tees are broken during teeing off and sometimes the broken tees are left on the tee box. This can cause difficulty in the maintenance of the golf course. The discarded tees may be cut up by the maintenance equipment. However, a wooden tee does not easily degrade and a plastic tee may not degrade at all. A biodegradable tee according to this invention if inadvertently left at the tee box would cause no problem to the groundskeepers, as the tee would ultimately degrade into harmless components. Consequently, forming the tee of the invention from biodegradable material further improves the desirability of using this invention.

Figure 2:
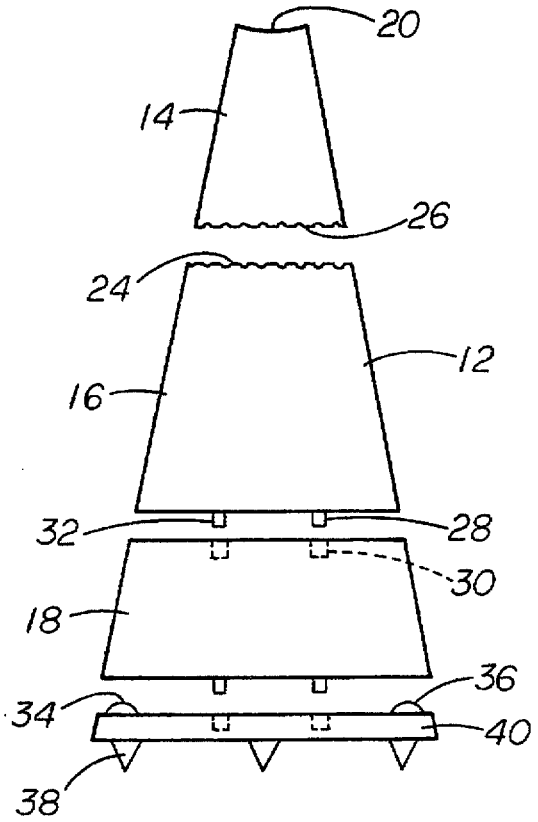
FIG. 2 illustrates an exploded front view of the device with sections detached.

FIG. 2 depicts means for disconnecting 24 sections of the body 12. Means for disconnecting 24 such as perforations 26 are hereshown provided between the adjacent sections 14, 16. Means for disconnecting 24 such as tabs 28 and interengaging receptacles 30 are hereshown provided between the adjacent sections 16, 18. The perforations 26 or the tabs 28 and interengaging receptacles 30 allow the sections to be separated as the user so desires. Means for reconnecting 32 the sections are shown as the tabs 28 and the interengaging receptacles 30, but other known connectors could be used herein, such as hook and loop fasteners (not shown).

Means for engaging 34 the surface of a tee box are provided on the tee. Rubber feet 36 are effective when the tee is used in conjunction with an artificial turf surface, whereas, spikes 38 are effective when the tee is used with natural grass. The means for engaging 34 the surface are disposed on the tee body 12 or on a base 40 attachable to the tee body 12. The base 40 can be reversible to present either the rubber feet 36 or the spikes 38 as the situation requires.

Figure 3:
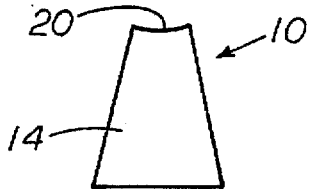
FIG. 3 illustrates a from view of the tee configured for high wind conditions.
Figure 4:
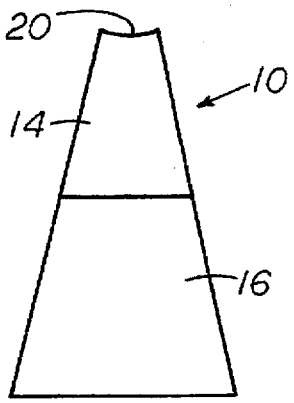
FIG. 4 illustrates a from view of the tee configured for low wind conditions.
Figure 5:
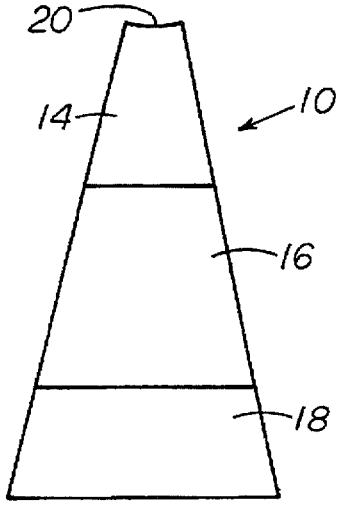
FIG. 5 illustrates a from view of the tee configured for no wind conditions.

For use outdoors, the golfer assesses the wind condition and decides how much height is needed for the tee. For use indoors on artificial turf, the golfer decides what type of shot to practice. By using different tee configurations and hence different heights, the golfer can simulate different outdoor conditions. The golfer then adjusts the tee to the desired configuration. The top section 14 is used alone for high wind conditions (FIG. 3). The top section 14 with the middle section 16 is used for low or moderate wind conditions (FIG. 4). While all the sections together, the top section 14, the middle section 16 and the lower section 18 are used for no wind conditions (FIG. 5).

The method of adjusting the golf tee for height comprises the step of disconnecting a separable section of the tee as depicted in FIG. 6. A further method of adjusting the golf tee for height comprises the step of reconnecting a separable section of the tee as is depicted in FIG. 7.

Having described the invention, many modifications thereto will become apparent to those skilled in the art to which it pertains without deviation from the spirit of the invention as defined in the appended claims.

I claim:

1. An adjustable heigh ball tee comprising:

a tapered body defined by a plurality of separable sections, said sections being different sized but having the same shape; said body further having an upper end configured to support a ball and a lower end larger than said upper end;

said base having spaced apart substantially parallel first and second planar surfaces;

Means on said surfaces for supporting said base on a support surface; said first and second surfaces being alternately attacheable to said base lower end; said means for supporting on said first surface being configured to penetrate a support surface and sadi means for supporting on said second surface being configured to rest on a support surface and being configured different from said means for supporting on said first surface.

2. The device according to claim 1 further comprising means for connecting the plurality of different sized sections.

3. The device according to claim 1 wherein the shape of the body is pyramidal.

4. The device according to claim 1 wherein the plurality of different sized sections are contiguous.

5. The device according to claim 1 wherein the body comprises plastic material.

6. The device according to claim 1 wherein the body comprises biodegradable material.

7. The adjustable height ball tee as defined in claim 1 wherein; same of said separable sections are connected by means of preforations and other of said section are connected by means tabs and mating tab receiving receptacles.

8. The adjustable height ball tee as defined in claim 1 wherein;

said mean for supporting on said first surface is a plurality of spikes and said means for supporting on said second surface is a plurality of rubber feet.

* * * * *